United States Patent [19]

Jenkins

[11] Patent Number: 4,742,696

[45] Date of Patent: May 10, 1988

[54] RING WITH REPLACEABLE STONES

[76] Inventor: Mary A. Jenkins, 364 Timberlane Dr., Gretna, La. 70053

[21] Appl. No.: 477,153

[22] Filed: Mar. 21, 1983

[51] Int. Cl.[4] ..... A44C 9/00; A44C 17/02

[52] U.S. Cl. ..... 63/15; 63/29.1 R

[58] Field of Search ..... 63/29 R, 18, 19, 15

[56] References Cited

U.S. PATENT DOCUMENTS 1,704,867 3/1929 Peters ..... 63/29 R

FOREIGN PATENT DOCUMENTS 781628 2/1935 France ..... 63/29 R 1319354 1/1962 France ..... 63/29 R 341345 11/1959 Switzerland ..... 63/29 R

*Primary Examiner*—Richard J. Johnson

*Attorney, Agent, or Firm*—A. Robert Theibault

[57] ABSTRACT

A ring or article of decorative jewelry is provided that has multiple interchangeable decorative stones. The ring is made with a flexible hinged top piece securing large polished stones against a bezel rising from the ring. The stones are securely gripped by the flexible spring action of the hinged lid and it is unnecessary that the stones themselves be placed in any sort of intermediate mounting.

1 Claim, 1 Drawing Sheet

RING WITH REPLACEABLE STONES

BACKGROUND OF THE INVENTION

This invention relates to articles of personal adornment, especially to rings for wearing on the fingers or similar jewelry having an ornamental or decorative, precious or semi-precious stone insert.

Previous attempts have been made to provide various articles of jewelry where the decorative portion of the jewelry can be interchanged. Typical of such attempts are U.S. Pat. No. 3,933,011, DiGilio et al, disclosing a ring having a removable and interchangeable jewelry mount. In the case of DiGilio, the ornamental portion of the ring is mounted in a rather complex structure having a keyed-interlocking mechanism which mates with slots on the jewelry to be worn. Variance of this construction may be seen, for example, in U.S. Pat. No. 3,307,375, Estrin, where a ring is provided with an interchangeable decorative stone. This patent shows a different interlocking mechanism but still discloses the general requirement that the decorative or ornamentive piece of the ring must itself be permanently affixed to a mount which can then be interlocked or interlinked to the ring.

U.S. Pat. No. 4,218,894, Tropea, and U.S. Pat. No. 2,674,107, Bodnar, both show various forms of elaborated mountings which are interchanged to the article of jewelry. The decorative portion of the jewelry is itself firmly affixed to the mounting.

Where it is desired to interchange simply the decorative stone, as would be desirable in the case of precious or semi-precious stone which may be damaged by being permanently affixed or glued to an intermediate mount, the prior art has, in order to securely affix the stone, consisted of various methods of mounting and clamping the stone insertably from the bottom of the ring, or the inside of the ring, against a strong, securely retaining net, such as shown, for instance, in U.S. Pat. No. 1,182,534, Drigott, showing a gem-clamping device to allow such a mounting. More recent versions of such interchangeable mountings are shown in U.S. Pat. No. 2,733,579, Pfeffer, and U.S. Pat. No. 3,913,184, Hannan. In all these cases the adequate securing of the unmounted stone requires a relatively complex mechanical locking in order to secure the stones. The stones themselves are restricted by the makeup of the ring or the jewelry to being a relatively small size and the stones are not interchangeable by the user without access to jewelers tools and some degree of mechanical skill.

It is the object of this invention to overcome the current usage restrictions of these prior art mountings by providing a ring having a simplified mounting method such that the user may himself/herself replace the decorative component of the ring or the precious stone therein as desired from a selection of decorative or precious stones.

It is a further object of the invention to provide a ring interchangeable mounting method permitting the use of much larger decorative stones than has heretofore been possible.

It is further an object of this invention to provide a ring which will mount interchangeable decorative or precious stones without requiring that an intermediate, permanent mounting be affixed to said decorative or precious stones.

In accordance with the invention, a ring is provided having an expanded, cup-shaped bezel of a light but strong wire-like configuration and of a size conformable to the desired size of the interchangeable stones to be provided. There is also provided adaptably conformed to the ring a series of various precious or semi-precious stones which can be of any generally symmetrical or pleasing shape, having only the condition that the outer edge shall be sized and shaped conformably with the upper outer edge of the bezel. Affixed to the bezel by a hinged means is a generally spring-like cover ring which, being pivoted on its hinge, may be lowered over any of the selection of provided stones firmly by spring-like action grasping and clamping the stone at its edges or periphery to the bezel. This spring-like edge or clasping ring is further provided opposite to the hinge with a catch or securing hook which secures and use both by the inate grasping of the design of the catch or hook itself as well as being further securely locked into position by the spring-like action of the top ring for securing lid.

For a better understanding of the invention, as well as the advantages and novel features thereof, reference is made to the following description which should be read in conjunction with the accompanying drawings which show by way of example the invention embodied in a ring for use upon the finger.

DETAILED DESCRIPTION OF THE INVENTION

Figure 1:
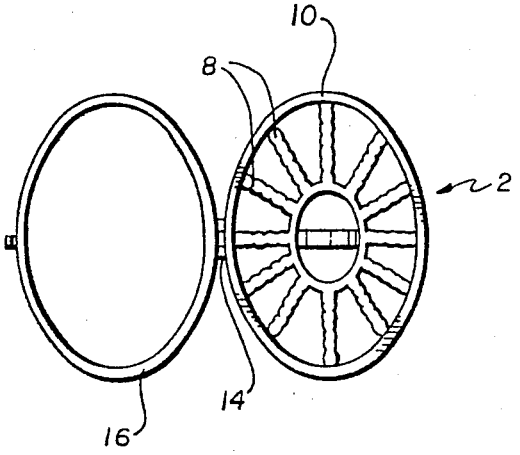
FIG. 1 is a top view of the device with no stone inserted.
Figure 4:
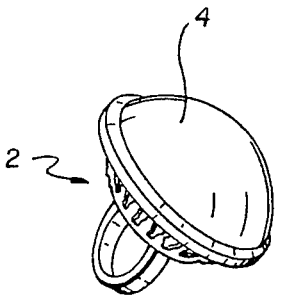
FIG. 4 is a perspective view of the device as it would be worn with a stone inserted.

Referring now more particularly to FIGS. 1 through 5 of the drawings, the reference numeral 2 refers generally to the device within which is placed any one of a number of removable, unmounted stones or similar decorative items 4.

Figure 2:
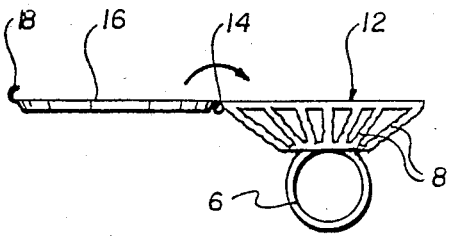
FIG. 2. is a front view of the device showing the hinge action of the spring lid.

Referring more specifically to FIG. 2, the device comprises essentially a ring 6 of design suitable for wearing upon a finger. Fixably attached to said ring 6 are a number of rising pillar members 8 which terminate in a bezel top ring 10 which is disposed essentially perpendicular to the ring 6.

The support members 8 and the bezel ring 10 together form the bezel 12.

Figure 3:
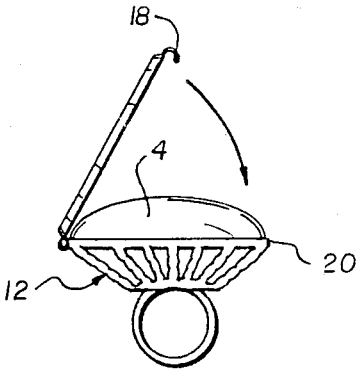
FIG. 3 is a front view of the device with a stone inserted showing the function.
Figure 5:
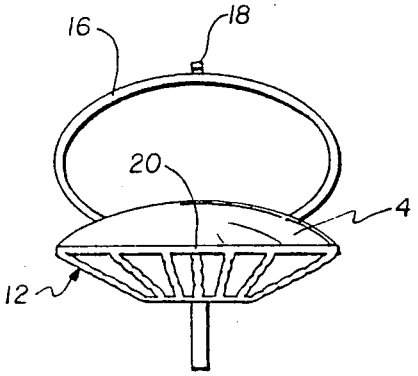
FIG. 5 is a side view of the device with a stone inserted showing another view of the lid.

Referring now particularlly to FIGS. 1, 3 and 5, the bezel ring 10 is seen to be of a desirable decorative shape having a somewhat wider surface on its top than its thickness. A number of decorative stones, not shown, all of which are polished and shaped to the general shape of the decorative stone 4, may be provided. Such stone 4 is placed, as shown in FIG. 3, conformatively upon the bezel member in the preferred embodiment resting primarily upon the surface of the ring 10. Provided also upon the ring 10, connected through hinge 14, is a top ring 16 which is of a shape adapatably sized to the configuration, shape and size of bezel top ring 10. Said securing ring or top lid 16 is comprised of an essentially springy resilient material in the preferred embodiment a gold-plated spring metallic component. Further provided on top lid 16 opposite to hinge 14 is catch 18 which mates upon closing with the lip, or outer edge, of top ring 10 at point 20. The hooking action of the clasp, together with the tension imposed by the spring action of top ring 16, securely closely the clasp securely holding ring 4.

In operation, the user finding the ring as shown in FIG. 2 with the lid open to its widest extent, as shown in FIG. 3, places therein a stone 4 selected as before stated from any of a number of similarly provided decorative stones cut to shape. Lid 16 is then pivoted about hinge 14 pressed downwardly, as shown in FIG. 3, until catch 18 engages with bezel lid top 10 at point 20. The spring tension upon lid 16 together with the hook 18, will, as is apparent to anyone skilled in the art, securely clasp over the ring 10 at point 20 holding stone 4 firmly within the ring 2.

As the user will wish to change stones, it is merely necessary to, with a fingernail or small implement such as fingernail file, pryingly separate clasp 18 from its hook location at point 20 around bezel top 10 permitting lid 16 to be raised, as shown in FIG. 5, and the stone thus being exposed to removal may be lifted out and replaced. The user then proceeds as before stated to insert yet another stone and repeat the process.

As can be seen from this description, it is not necessary that stone itself have permanently affixed to a mount nor is there a mount upon the stone which is required for interlocking with the ring.

Specific tools or skills or not required to open or close the ring. There are no loose moving parts provided, yet the spring action of the top lid and bezel being applied at the outer periphery uniformly about the stone 4 will securely clasp the stone 4 against any tendency for it to be ejected or lost.

Further as may be seen from the description, the limit to the extent of the pilllars 8 and thereby the size of the ring 10, the bezel and the resulting permitted size of the stone 4 conformably matching thereto is limited essentially by the artistic desires of the specific ring constructed, thereby particularly large stones are permitted to be used interchangeably for a more pleasing decorative effect.

From the above it can thus be seen that the invention comprises, in addition to the specific configuration discussed, such similar configurations and sizes as would appear readily to those skilled in the art.

What is claimed is:

1. An article for securing an interchangeable stone upon a ring bezel or jewelry flat surface comprising:

(a) a base having means for attachment of the ring to the finger of a person;

(b) a plurality of posts radially affixed to and upstanding from said ring base;

(c) a bezel base having an essentially flat extended top secured to the non-base ends of said posts;

(d) an open clamping lid hingedly affixed to one side of said bezel base and being geometrically similar to said bezel base, having an open central area;

(e) a plurality of interchangeable stones of decorative appearance geometrically similar to said bezel base and clamping lid one of which is to be restrained therebetween and exposed to view through the open central area of said lid;

(f) and a hook clasp on the side of said clamping lid remote from said hinge for securing said lid over the stone and removably clamping the stone against the bezel until the wearer desires to change the decorative stone with another.

* * * * *